US010875029B2

(12) United States Patent
Tsai et al.

(10) Patent No.: US 10,875,029 B2
(45) Date of Patent: Dec. 29, 2020

(54) PAPER SCRAP PUSHING STRUCTURE OF PAPER SHREDDER

(71) Applicant: Aurora Office Equipment Co., Ltd. Shanghai, Shanghai (CN)

(72) Inventors: Chung Shih Tsai, Hawthorne, CA (US); Erren Zhong, Shanghai (CN); Guanglong Chen, Shanghai (CN)

(73) Assignee: Aurora Office Equipment Co., Ltd. Shanghai, Shanghai (CN)

( * ) Notice: Subject to any disclaimer, the term of this patent is extended or adjusted under 35 U.S.C. 154(b) by 142 days.

(21) Appl. No.: 15/885,410

(22) Filed: Jan. 31, 2018

(65) Prior Publication Data

US 2019/0232299 A1 Aug. 1, 2019

(51) Int. Cl.
*B02C 18/00* (2006.01)
*B02C 18/22* (2006.01)

(52) U.S. Cl.
CPC ..... *B02C 18/0007* (2013.01); *B02C 18/22* (2013.01); *B02C 18/2216* (2013.01); *B02C 18/2225* (2013.01); *B02C 18/2275* (2013.01); *B02C 2018/0061* (2013.01)

(58) Field of Classification Search
CPC . B02C 18/2275; B02C 18/0007; B02C 18/22; B02C 18/2216; B02C 18/2225; B02C 2018/0061; B02C 18/2233; B02C 2018/0046; B02C 2018/0069; B30B 9/3035
USPC ..... 241/222, 236
See application file for complete search history.

(56) References Cited

U.S. PATENT DOCUMENTS 8,574,232 B1 * 11/2013 Ross ..... A61F 5/042 606/57
2011/0297767 A1 * 12/2011 Jiang ..... B02C 18/24 241/34

FOREIGN PATENT DOCUMENTS

CN 202129130 U * 2/2012
CN 107164572 A * 9/2017
CN 108220487 A * 6/2018
(Continued)

OTHER PUBLICATIONS

Translation of DE 102017118889 A1 (Year: 2019).*
(Continued)

*Primary Examiner* — Shelley M Self
*Assistant Examiner* — Teresa A Guthrie
(74) *Attorney, Agent, or Firm* — WHGC, P.L.C.; John F. O'Rourke

(57) ABSTRACT

A paper scrap pushing structure of a paper shredder, including a rotating shaft, a paper pushing rod, and connecting rods, in which the rotating shaft is arranged under a paper outlet, and is in linkage with a paper shredder cutter shaft through a synchronous transmission device. The paper pushing rod is located on one side of the rotating shaft, arranged in the length direction of the rotating shaft in parallel and connected with the rotating shaft through the connecting rods. The distance from the paper pushing rod to the rotating shaft is smaller than the distance from the lowest portion of the paper shredder cutter shaft to the rotating shaft. When rotating, the rotating shaft drives the paper pushing rod to move in a circumferential direction through the connecting rods, removing paper scraps at the top of a paper scrap pile in a shredded paper waste bin.

2 Claims, 4 Drawing Sheets

(56) References Cited

FOREIGN PATENT DOCUMENTS

| | | | | |
|---|---|---|---|---|
| DE | 102017118889 A1 * | 2/2019 | ..... | B02C 18/16 |
| JP | 2009213950 A * | 9/2009 | | |

OTHER PUBLICATIONS

Translation of CN 108220487 A (Year: 2018).*
Translation of CN 202129130 U (Year: 2012).*
Translation of JP 2009213950 A (Year: 2009).*
Translation of CN 107164572 A (Year: 2017).*

* cited by examiner

PAPER SCRAP PUSHING STRUCTURE OF PAPER SHREDDER

BACKGROUND OF THE EMBODIMENTS

1. Technical Field

The embodiments relates to the technical field of paper scrap processing of paper shredders, in particular to a paper scrap pushing structure of a paper shredder.

2. Description of Related Art

Paper shredders are machines used for processing paper scraps and can cut waste paper into strip-shaped or granular paper scraps; however, the strip-shaped or granular paper scraps can be locally stacked in shredded paper waste bins without being processed, subsequent paper scraps cannot fall down smoothly due to piled paper scraps, and consequentially the paper scraps overflows out of the shredded paper waste bin soon, affecting the overall operating function of the paper shredder.

Previously, swinging mechanisms were used for making paper scraps fall into shredded paper waste bins in a swinging mode. For example, a swinging paper shifting mechanism at a paper falling port of a paper shredder is disclosed by the embodiments patent with the Chinese patent application No. CN200720000902. Here, the swinging paper shifting mechanism includes a motor and a cutter assembly provided with a transmission gear and arranged in a case. A waste paper waste bin used for collecting paper scraps is arranged below the cutter assembly. The mechanism also includes a swinging plate arranged near the paper falling port of the case and connected with a transmission shaft through a connecting rod. A driven gear is arranged at one end of the transmission shaft and receives power from the cutter assembly to rotate. The transmission shaft drives the swinging plate to reciprocate forward and backward through the connecting rod when rotating, paper scraps evenly falls down into the waste paper waste bin from a cutter shaft and are flatly piled up gradually, so that the space for containing paper scraps in the waste paper waste bin is increased. In this patent, the swinging plate can only reciprocate around the transmission shaft, and consequentially the transmission structures of the two sides of the transmission shaft are complex.

A uniform paper scrap shifting device of a paper shredder is disclosed by the embodiments patent with the Chinese patent application No. CN200920261627. In this patent, the uniform paper scrap shifting device includes a second swinging support, a swinging plate, a first swinging support, a swinging rod, a rotating shaft and an adjustable support, wherein one end of the rotating shaft is fixed to a paper shredder cutter shaft and concentrically rotates along with the cutter shaft. The adjustable support is arranged at the other end of the rotating shaft. A convex column of the adjustable support is slidably sleeved with a guide rail trough, and the other end of the swinging rod is connected with the first swinging support through a D-shaped shaft hole. The second swinging support is fixed to the paper shredder. The two ends of the swinging plate are fixed to a swinging arm of the first swinging support and a swinging arm of the second swinging support respectively. In this patent, since the swinging plate is of an integral structure, only the side of the swinging plate, away from the rotating shaft, can be used for removing paper scraps, materials are wasted, and the structure is not simple.

A paper shredder is disclosed by the embodiments patent with the Chinese patent application No. CN200920274623. The paper shredder is provided with a positioned rotating device, which is adjacent to a discharging port of a paper shredder shell. The rotating device comprises a shaft, and the shaft can rotate around an axis parallel to the axis of a cutting assembly so that the rotating device can rotate. The rotating device is provided with a plurality of finger parts which can at least partially extent in the radial direction from the shaft. The rotating device can rotate around the axis of the shaft in any direction so that any accumulated shredded paper in a waste box can be dispersed and shredded paper collected in a cutting assembly adjacent to the discharging port or nearby can be removed. In this patent, because the finger parts are elastic and are relatively scattered, the scrap removal effect is not ideal enough.

A paper scrap distribution device of a paper shredder is disclosed by the embodiments patent with the Chinese patent application No. CN201120214524. The paper scrap distribution device comprises distribution blades and a rotating shaft in linkage with a paper shredder cutter shaft. The distribution blades are arranged on the rotating shaft in the length direction. The number of the distribution blades is at least two, with the plastic or metal distribution blades are arranged at intervals. A wheel disc in linkage with the paper shredder cutter shaft is arranged at one end of the rotating shaft. Alternately, a gear in linkage with the paper shredder cutter shaft is arranged at one end of the rotating shaft. A housing can be mounted at a paper outlet of the paper shredder. The rotating shaft is rotatable arranged in the housing, and the bottom of the housing is open. In this patent, since the distribution blades are integral blades, only the parts, on the side away from the rotating shaft, of the blades can be used for removing paper scraps, materials are wasted, and the structure is not simple.

What is needed is a paper scrap pushing apparatus for a paper shredder that overcomes the above problems.

SUMMARY

For overcoming the shortcomings of the prior art, the embodiments herein provide a paper scrap pushing structure of a paper shredder. The paper scrap pushing structure of the paper shredder is clever in design, simple in structure, and practical in function. Also it has a better paper scrap distribution function and is suitable for large-scale application and commercialization.

A paper scrap pushing structure of a paper shredder includes a rotating shaft, a paper pushing rod and a plurality of connecting rods, wherein the rotating shaft is arranged under a paper outlet of the paper shredder and is in linkage with a paper shredder cutter shaft through a synchronous transmission device. The paper pushing rod is located on one side of the rotating shaft, arranged in the length direction of the rotating shaft in parallel, and connected with the rotating shaft through the multiple connecting rods. The distance from the paper pushing rod to the rotating shaft is generally smaller than the distance from the lowest portion of the paper shredder cutter shaft to the rotating shaft. A paper pushing unit is defined by the rotating shaft, the connecting rods and the paper pushing rod. When the rotating shaft rotates, the rotating shaft drives the paper pushing rod to move in the circumferential direction through the connecting rods so as to remove paper scraps at the top of a paper scrap pile in a shredded paper waste bin.

Furthermore, in an embodiment, included are the left connecting rod and the right connecting rod, with the left connecting rod and the right connecting rod being located at the respective ends of the paper pushing rod and the rotating shaft. In another embodiment, the left connecting rod and the right connecting rod are each of a telescopic structure, and springs are arranged at the ends, proximate to one end of the rotating shaft, of the left connecting rod and the right connecting rod.

Furthermore, in yet another embodiment, the number of the connecting rods is three, the three connecting rods are the left connecting rod, the middle connecting rod and the right connecting rod respectively. The left connecting rod, the middle connecting rod, and the right connecting rod are arranged between the paper pushing rod and the rotating shaft at generally equal intervals. In still another embodiment, the left connecting rod and the right connecting rod are each of a telescopic structure, and the middle connecting rod is of a sleeve structure. The springs are arranged at the ends, proximate to one end of the rotating shaft, of the left connecting rod and the right connecting rod. The middle connecting rod comprises an inner sleeve and an outer sleeve. The inner sleeve is perpendicularly connected with the rotating shaft, and the outer sleeve is perpendicularly connected with the paper pushing rod. In a further embodiment the inner sleeve is perpendicularly connected with the paper pushing rod, and the outer sleeve is perpendicularly connected with the rotating shaft.

In another embodiment, the paper pushing rod and the multiple connecting rods are formed integrally. In yet another embodiment, the paper pushing rod and/or the connecting rods are made of plastic or rubber or metal.

Embodiments of the paper scrap pushing structure of the paper shredder can further include two inverted ti-shaped guide grooves oppositely arranged on the inner walls of side plates on the two sides of the paper shredder. Here, the paper pushing rod enters the inverted U-shaped guide grooves when rotating around the rotating shaft in the circumferential direction and is compressed to be prevented from colliding with the paper shredder cutter shaft above.

Moreover, the radial angle (radian) of each inverted U-shaped guide groove is decreased gradually, and the distance from the portion, with the smallest radian, of each inverted U-shaped guide groove to the center of the rotating shaft is slightly greater than the distance from the side, away from the rotating shaft, of the paper pushing rod to the center of the rotating shaft.

In an embodiment, the number of the paper pushing units is equal to or larger than two, and the paper pushing units are arranged in the circumferential direction of the rotating shaft at intervals.

In an embodiment, the paper pushing units are arranged in the circumferential direction of the rotating shaft at equal intervals.

In an embodiment, the synchronous transmission device includes a gear set, the two ends of the rotating shaft are connected with gear shafts arranged on the two sides of the paper shredder, and the rotating shaft is in synchronous linkage with the paper shredder cutter shaft through engaging movement of gears in the gear set.

Furthermore, in another embodiment, the synchronous transmission device includes a cutter shaft gears and rotating shaft gears, the cutter shaft gears are arranged at the two ends of the paper shredder cutter shaft, the rotating shaft gears are arranged at the two ends of the rotating shaft, and the cutter shaft gears are in synchronous linkage with the rotating shaft gears through a synchronous belt.

BRIEF DESCRIPTION OF THE DRAWINGS

For a clearer illustration of the technical scheme of the embodiments, a brief description of the drawings required for illustration of the embodiments is given as follows. Obviously, the drawings in the following description are only for part of the embodiments, and for those skilled in the field, other drawings can also be obtained according to the drawings without creative work. In the drawings.

Figure 1:
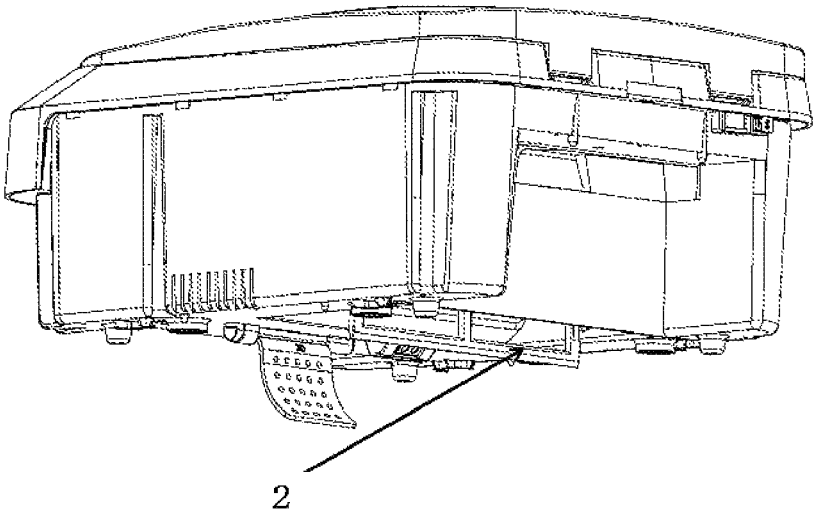
FIG. 1 is a diagram of a paper pushing unit in the paper scrap pushing structure of the paper shredder of the embodiments.
Figure 2:
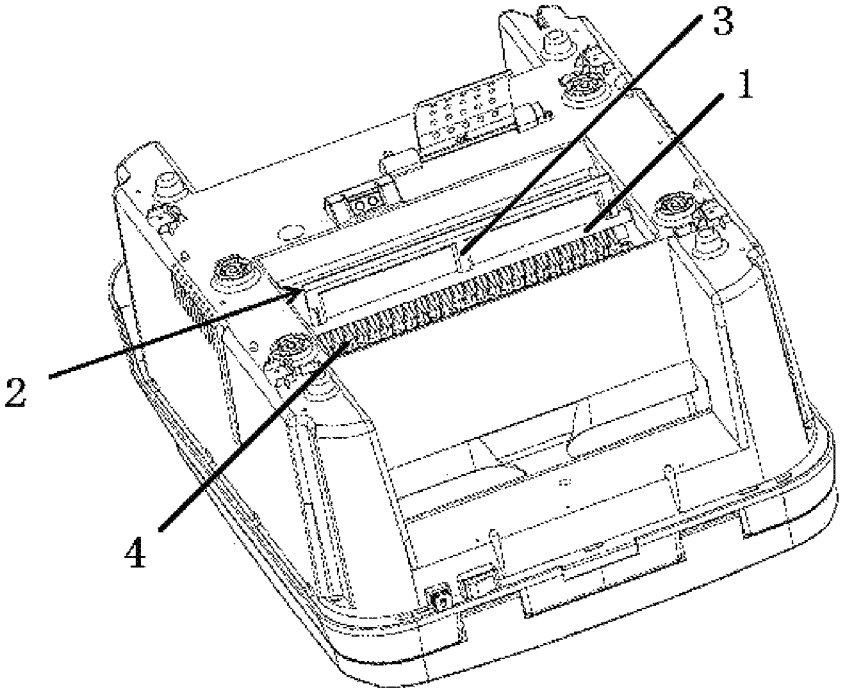
FIG. 2 is a diagram of the part and shape, at the paper outlet of the paper shredder, of the paper pushing unit in the paper scrap pushing structure of the paper shredder of the embodiments.

Some embodiments are described in detail with reference to the related drawings. Additional embodiments, features and/or advantages will become apparent from the ensuing description or may be learned by practicing the invention. In the figures, which are not drawn to scale, like numerals refer to like features throughout the description. The following description is not to be taken in a limiting sense, but is made merely for the purpose of describing the general principles of the invention.

DETAILED DESCRIPTION OF THE EMBODIMENTS

A clear and complete description and discussion of the technical scheme in the embodiments are given with the accompanying drawings as follows. Only several of the embodiments of the present invention are described, and all other embodiments obtained by those skilled in the field without creative work based on the embodiments are within the protected scope of the claims.

In general, when the paper shredder is in typical use, paper scraps generated after paper is shredded, fall down and form a paper scrap pile. When the paper scrap pile exceeds a certain height, the paper pushing units located below the paper outlet of the paper shredder can push the paper scraps at the top of the paper scrap pile to create a more even distribution of paper scraps in a shredder waste bin. The rotating gears and the cutter shaft gears of the paper shredder cutter shaft drive the paper pushing units, and the paper shredder cutter shaft, to rotate synchronously through the synchronous belt or through synchronized engagement of the gear set. As a result, the paper scraps are distributed orderly and can be evenly piled in the shredded paper waste bin, and thus the space utilization rate of the paper waste bin is effectively increased.

As is shown in FIGS. 1-6, the embodiments disclose a paper scrap pushing structure of a paper shredder. The paper scrap pushing structure of the paper shredder includes rotating shaft 1, paper pushing rod 2, and plurality of connecting rods 3, in which rotating shaft 1 is arranged under a paper outlet of the paper shredder and is in linkage with a paper shredder cutter shaft 4 through a synchronous transmission device 9. Paper pushing rod 2 may be located on one side of the rotating shaft 1, arranged in parallel in the length direction of the rotating shaft 1, and connected with the rotating shaft 1 through plurality of connecting rods 3. In general, the distance from paper pushing rod 2 to rotating shaft 1 is smaller than the distance from the lowest portion of paper shredder cutter shaft 4 to rotating shaft 1. When rotating shaft 1 rotates, rotating shaft 1 drives paper pushing rod 2 to move in the circumferential direction through the connecting rods 3, removing paper scraps at the top of a paper scrap pile disposed in a shredded paper waste bin.

In an embodiment, the number of connecting rods 3 is two, the two connecting rods 3 being left connecting rod 31 and right connecting rod 32 respectively. Left connecting rod 31 and right connecting rod 32 can be located at the ends of paper pushing rod 2 and rotating shaft 1, respectively. To achieve the paper scrap distribution effect, the two connecting rods 31, 32 are simple in structure and reasonable in design, and materials be saved. In an embodiment, the left connecting rod 31 and the right connecting rod 32 can be each of a telescopic structure, with springs 7 being arranged at the ends proximate to an end of the rotating shaft 1, and to left connecting rod 31 and right connecting rod 32.

Figure 3:
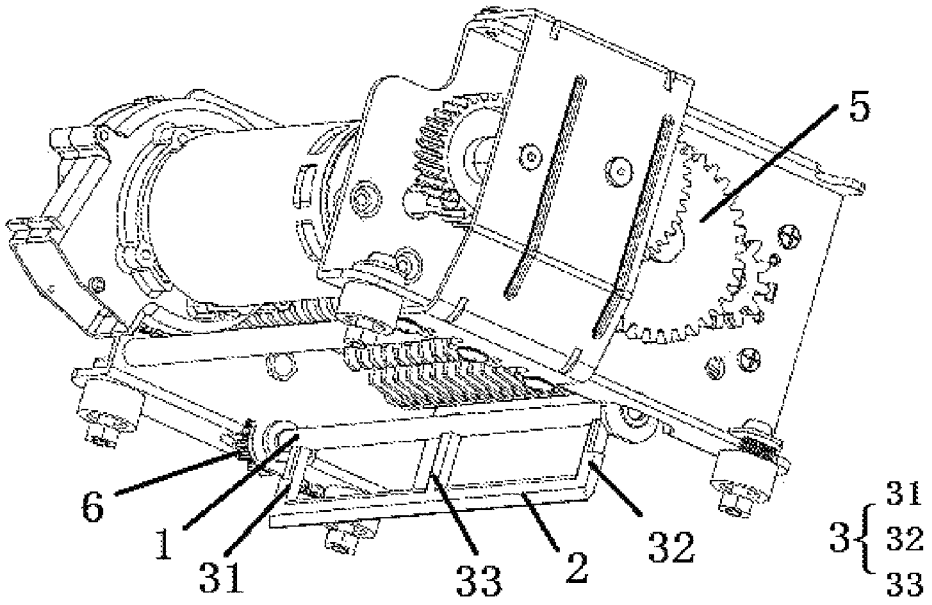
FIG. 3 is a structural diagram of the paper pushing unit in the paper scrap pushing structure of the paper shredder of the embodiments.
Figure 5:
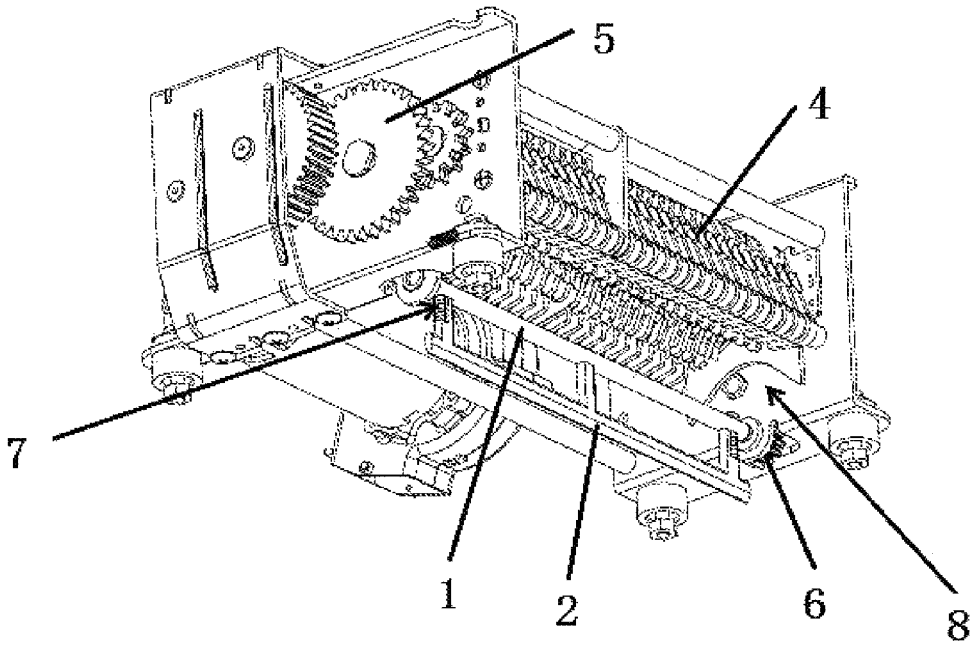
FIG. 5 is a forward structural diagram of the telescopic paper pushing unit in the paper scrap pushing structure of the paper shredder of the embodiments.
Figure 6:
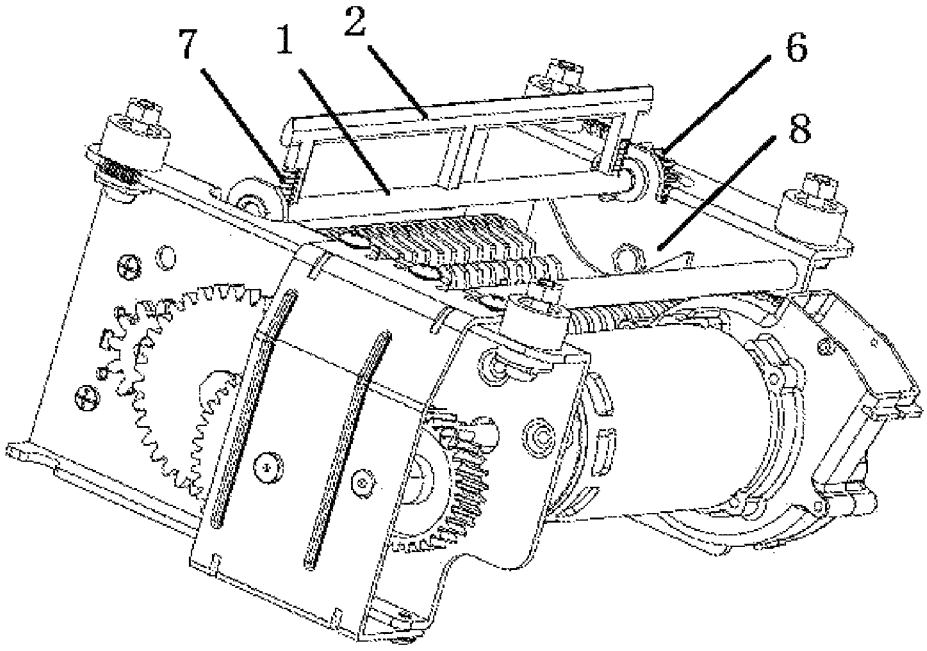
FIG. 6 is an inverted structure diagram of the telescopic paper pushing unit in the paper scrap pushing structure of the paper shredder of the embodiments.
Figure 7:
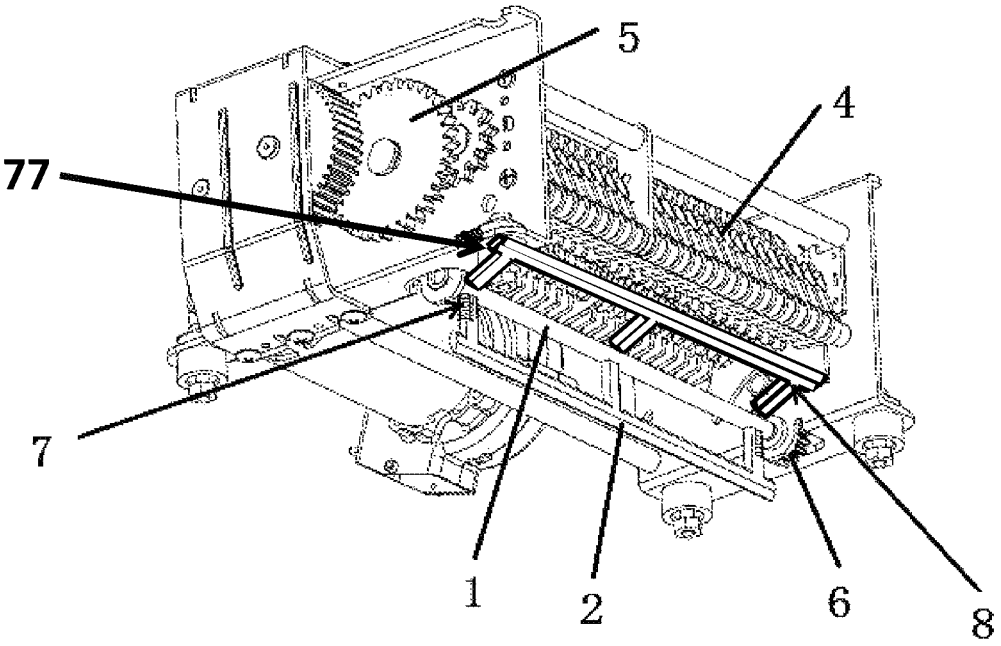
FIG. 7 is a forward structural diagram of plural telescopic paper pushing units in the paper scrap pushing structure of the paper shredder of the embodiments.
Figure 8:
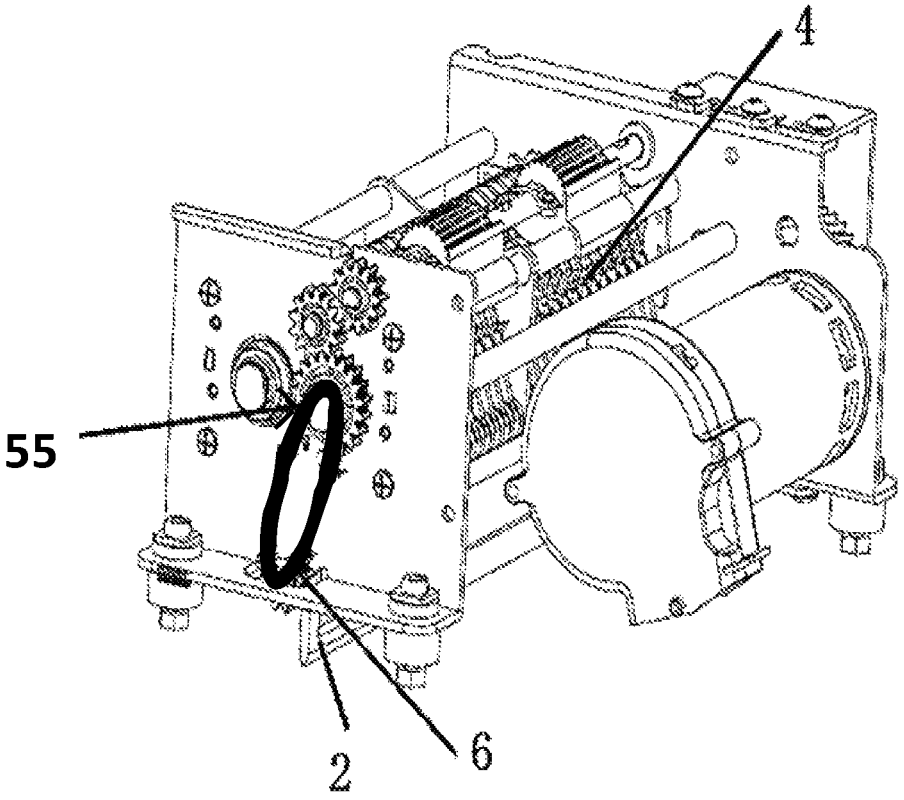
FIG. 8 is a structural diagram of a synchronous belt transmission device in the paper scrap pushing structure of the paper shredder of the embodiments.

As is shown in FIG. 3, FIG. 5 and FIG. 6, in another embodiment, the number of the connecting rods 3 can be three, the three connecting rods can be left connecting rod 31, middle connecting rod 33 and right connecting rod 32, respectively. Left connecting rod 31, middle connecting rod 33, and right connecting rod 32 can be arranged between the paper pushing rod 2 and rotating shaft 1, for example, at equal intervals. By arranging the connecting rods at equal intervals, force borne by paper pushing rod 2 can be evenly distributed to the connecting rods 3 when paper pushing rod 2 operates, and thus the service life can be prolonged. In the embodiment, the connecting rods 3 can be connected with paper pushing rod 2 and rotating shaft 1, for example, by insertion, by riveting, or by welding. In an embodiment, left connecting rod 31 and right connecting rod 32 can be each of a telescopic structure, and the middle connecting rod 33 can be of a sleeve structure. Springs 7 can be arranged proximate to each end of rotating shaft 1, and on left connecting rod 31 and right connecting rod 32. Middle connecting rod 33 can include an inner sleeve 41 and an outer sleeve 42. Inner sleeve 41 can be perpendicularly connected with the rotating shaft 1, and outer sleeve 42 can be perpendicularly connected with paper pushing rod 2. In another embodiment, inner sleeve 41 can be perpendicularly connected with paper pushing rod 2, and outer sleeve 42 can be perpendicularly connected with rotating shaft 1.

As is shown in FIG. 5 and FIG. 6, in another embodiment, the paper scrap pushing structure further includes two inverted U-shaped guide grooves 8 oppositely arranged on the inner walls of side plates 10 on the two opposing sides of the paper shredder. The radial angle (radian) of each inverted U-shaped guide groove 8 can be decreased gradually, and the distance from the portion with the smallest radian of each inverted U-shaped guide groove 8 to the center of rotating shaft 1 can be slightly greater than the distance from the side away from rotating shaft 1 of paper pushing rod 2 to the center of rotating shaft 1. Paper pushing rod 2 enters inverted U-shaped guide grooves 8 when rotating around rotating shaft 1 in the circumferential direction. Springs 7 of left connecting rod 31 and right connecting rod 32, and sleeves 41, 42 of middle connecting rod 33, are gradually compressed along with the decrement of the radians of inverted U-shaped guide grooves 8, so that paper pushing rod 2 is prevented from colliding with paper shredder cutter shaft 4 above. After paper pushing rod 2 passes through inverted U-shaped guide grooves 8, springs 7 return to their prior state. Through the design of springs 7, the distance between rotating shaft 1 and paper shredder cutter shaft 4 can be further decreased easily, the space of the shredder paper waste bin, below rotating shaft 1 of the paper shredder is effectively increased accordingly, the size of the paper shredder can be further decreased on the basis that the space of the shredded paper waste bin is not changed. The cost of the paper shredder and the space occupied by the paper shredder can be reduced indirectly.

In an embodiment, paper pushing rod 2 and plurality of connecting rods 3 can be formed integrally. Through the integral design, the firmness between the paper pushing rod and the connecting rods can be improved easily, and the paper pushing rod and the connecting rods are not prone to being separated after extended use. When rotating shaft 1, paper pushing rod 2, and connecting rods 3 are made of the same materials, rotating shaft 1, paper pushing rod 2, and connecting rods 3 can also be formed integrally.

Paper pushing unit 11 can include rotating shaft 1, paper pushing rod 2, and connecting rods 3. The number of paper pushing units it can be set freely and can be one or more. In embodiments, the number of paper pushing units 11 is equal to or larger than two, coupled to rotating shaft 1, and paper pushing units 11 can be arranged in the circumferential direction of the rotating shaft at intervals. For achieving a better paper scrap distribution effect, paper pushing units 11 can be arranged in the circumferential direction of the rotating shaft at equal intervals. In certain embodiments, the number of paper pushing units 11 can be two or four or six. However, it is not true that the more paper pushing units 11 there are, the better the effect is; if excessive paper pushing units are provided, the material cost can be increased, the structure can more complex, and the paper scrap distribution efficiency may be low.

In the embodiments, paper pushing rod 2, connecting rods 3, or both, can be made of plastic, or rubber, or metal. In an economical paper pushing device of a paper shredder, paper pushing rod 2 and connecting rods 3 preferably can be made of plastic, which is low in price and proper in hardness.

Figure 4:
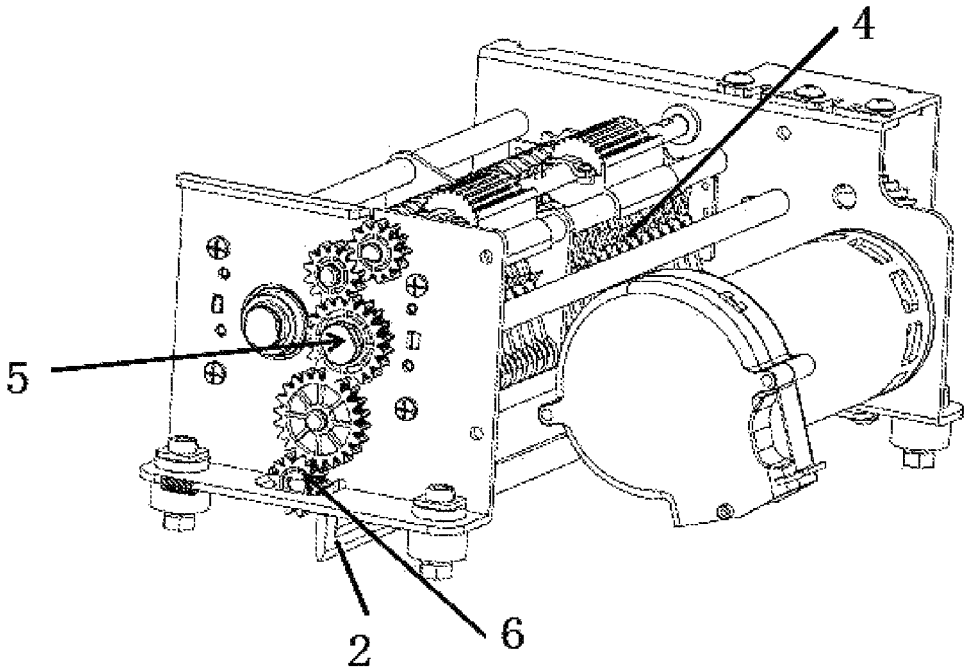
FIG. 4 is a structural diagram of a synchronous gear transmission device in the paper scrap pushing structure of the paper shredder of the embodiments.

Rotating shaft 1 can be in linkage with paper shredder cutter shaft 4 in multiple ways. As is shown in FIG. 4, in one embodiment, synchronous transmission device 9 can be a gear set, the two ends of rotating shaft 1 can be connected with gear shafts arranged on the two sides of the paper shredder, and rotating shaft 1 can be in synchronous linkage with paper shredder cutter shaft 4 through engaging movement of gears in the gear set. In another embodiment, synchronous transmission device 9 includes cutter shaft gears 5 and rotating shaft gears 6. Cutter shaft gears 5 can be arranged at the two ends of paper shredder cutter shaft 4, rotating shaft gears 6 can be arranged at the two ends of rotating shaft 1, and cutter shaft gears 5 can be in synchronous linkage with rotating shaft gears 6 through a synchronous belt.

The above embodiments are only preferred specific embodiments of the embodiments, the protection scope of the embodiments is not limited to the above embodiments, and changes or substitutes which can be easily obtained by those skilled in the field within the technical scope disclosed by the embodiments should all be within the protection scope of the embodiments. Therefore, the protection scope of the embodiments is subject to the protection scope defined by the claims.

What is claimed is:

1. A paper scrap pushing structure of a paper shredder having two opposing sides, comprising:

a paper pushing unit, including a common rotating shaft, a paper pushing rod, arranged in the length direction of the common rotating shaft in parallel, and two connecting rods, connecting the common rotating shaft to the paper pushing rod;

wherein the two connecting rods are the left connecting rod and the right connecting rod respectively, with the left connecting rod and the right connecting rod being located at respective ends of the paper pushing rod and the common rotating shaft, wherein the common rotating shaft is arranged under a paper outlet of the paper shredder and is in linkage with a paper shredder cutter shaft through a synchronous transmission device, wherein the distance from the paper pushing rod to the common rotating shaft is smaller than the distance from the lowest portion of the paper shredder cutter shaft to the common rotating shaft, wherein the left connecting rod and the right connecting rod are each a telescopic structure, and springs are arranged proximate to respective ends of the common rotating shaft on the left connecting rod and the right connecting rod and wherein when the common rotating shaft rotates, the common rotating shaft drives the paper pushing rod to move in the circumferential direction through the connecting rods, removing paper scraps at the top of a paper scrap pile in a shredded paper waste bin and two inverted U-shaped guide grooves oppositely arranged on inner walls of side plates on the two opposing sides of the paper shredder, wherein the paper pushing rod enters the inverted U-shaped guide grooves when rotating around the common rotating shaft in the circumferential direction and is compressed to be prevented from colliding with the paper shredder cutter shaft above.

2. A paper scrap pushing structure, of a paper shredder having two opposing sides, comprising:

a paper pushing unit, including a common rotating shaft;

a paper pushing rod, arranged in the length direction of the common rotating shaft in parallel; and three connecting rods, connecting the common rotating shaft to the paper pushing rod, the three connecting rods being the left connecting rod, the middle connecting rod and the right connecting rod respectively, wherein the left connecting rod, the middle connecting rod, and the right connecting rod are arranged at equal intervals between the paper pushing rod and the common rotating shaft, wherein the common rotating shaft is arranged under a paper outlet of the paper shredder and is in linkage with a paper shredder cutter shaft through a synchronous transmission device, wherein the distance from the paper pushing rod to the common rotating shaft is smaller than the distance from the lowest portion of the paper shredder cutter shaft to the common rotating shaft, and wherein when the common rotating shaft rotates, the common rotating shaft drives the paper pushing rod to move in the circumferential direction through the connecting rods, removing paper scraps at the top of a paper scrap pile in a shredded paper waste bin two inverted U-shaped guide grooves oppositely arranged on inner walls of side plates on the two opposing sides of the paper shredder, wherein the paper pushing rod enters the inverted U-shaped guide grooves when rotating around the common rotating shaft in the circumferential direction and is compressed to be prevented from colliding with the paper shredder cutter shaft above.

* * * * *